US007223138B2

(12) United States Patent
Fuse

(10) Patent No.: US 7,223,138 B2
(45) Date of Patent: May 29, 2007

(54) WATER JET PROPELLER

(75) Inventor: Tomohiro Fuse, Saitama (JP)

(73) Assignee: Honda Motor Co., Ltd (JP)

( * ) Notice: Subject to any disclaimer, the term of this patent is extended or adjusted under 35 U.S.C. 154(b) by 34 days.

(21) Appl. No.: 11/214,771

(22) Filed: Aug. 31, 2005

(65) Prior Publication Data

US 2006/0057907 A1 Mar. 16, 2006

(30) Foreign Application Priority Data

Sep. 10, 2004 (JP) ..... 2004-264215

(51) Int. Cl.
*B63H 11/00* (2006.01)
*B63H 11/113* (2006.01)

(52) U.S. Cl. ..... 440/38; 440/42

(58) Field of Classification Search ..... None
See application file for complete search history.

(56) References Cited

U.S. PATENT DOCUMENTS 3,942,464 A * 3/1976 Schoell ..... 440/41
5,346,363 A * 9/1994 Stallman et al. ..... 415/197
6,244,913 B1 * 6/2001 Matsumoto et al. ..... 440/38

FOREIGN PATENT DOCUMENTS

JP 9-99897 A 4/1997

* cited by examiner

*Primary Examiner*—Jesus Sotelo
*Assistant Examiner*—Daniel V. Venne
(74) *Attorney, Agent, or Firm*—Birch, Stewart, Kolasch & Birch, LLP

(57) ABSTRACT

A water jet propeller for preventing an impeller from being exposed when the water jet propeller is disassembled. The water jet propeller includes a stator disposed at a rear-end portion of an impeller housing, and an impeller is disposed inside the impeller housing. The water jet propeller expels a water jet by rotating the impeller. The impeller of the water jet propeller is rotatably mounted to the stator, being disposed inside the impeller housing. The impeller housing, the stator, and a nozzle are connected integrally with each other using a connection bolt. The impeller housing and the stator are connected integrally with each other using a lock bolt.

18 Claims, 11 Drawing Sheets

WATER JET PROPELLER

CROSS-REFERENCE TO RELATED APPLICATION

The present application claims priority under 35 U.S.C. § 119 to Japanese Patent Application No. 2004-264215, filed Sep. 10, 2004, the entire contents of which are hereby incorporated by reference.

BACKGROUND OF THE INVENTION

1. Field of the Invention

The present invention relates to a water jet propeller having an impeller disposed inside an impeller housing and making the impeller rotate to expel a water jet.

2. Description of Background Art

Conventionally, the water jet propeller is mounted in a rear portion of a hull and draws in water from a hull bottom by driving the impeller with an engine and expelling the water drawn therein rearward, thereby propelling a watercraft See, for example, Japanese Patent Laid-open No. Hei 9-99897.

The art disclosed in Japanese Patent Laid-open No. Hei 9-99897 will be described with reference to FIG. 11.

FIG. 11 is a view for illustrating a basic construction of the conventional water jet propeller.

A water jet propeller 200 includes an impeller housing 203, a stator 204, a nozzle 205, and a steering nozzle 207. The impeller housing 203, of a cylindrical shape, is disposed in a rear portion 202 of a hull 201. The stator 204, of a cylindrical shape, is disposed at a rear-end portion 203*a* of the impeller housing 203. The nozzle 205 having a diminishing diameter rearwardly is disposed at a rear-end portion 204*a* of the stator 204. The steering nozzle 207 is fitted to the nozzle 205 via upper and lower pins 206, 206 swingably in a crosswise direction.

An impeller 208 is disposed inside the impeller housing 203. A rotational shaft 209 of the impeller 208 is extended to reach into the stator 204. The extended rotational shaft 209 is rotatably mounted in the stator 204 via bearings 211, 211.

According to the water jet propeller 200, the impeller 208 disposed inside the impeller housing 203 is rotated by an engine (not shown). A water jet is thereby expelled from a rear-end portion 207*a* of the steering nozzle 207 to propel the hull 201.

The steering nozzle 207 is swung to the right or to the left about an axis of the upper and lower pins 206, 206, thereby allowing the hull 201 to turn right or left.

The water jet propeller 200 generally uses a connection bolt (not shown) as means for mounting the impeller housing 203, the stator 204, and the nozzle 205 integrally together.

More specifically, each of the impeller housing 203, the stator 204, and the nozzle 205 includes a mounting portion (not shown) disposed on an outer wall thereof. The connection bolt is passed through the mounting portion of the impeller housing 203, the mounting portion of the stator 204, and the mounting portion of the nozzle 205. The impeller housing 203, the stator 204, and the nozzle 205 are thereby connected integrally together.

The water jet propeller 200 may be disassembled for purposes of, for example, performing a service job, by removing the connection bolt. In such cases, the impeller housing 203, the stator 204, and the nozzle 205 can be separated from each other.

It is to be noted herein that the rotational shaft 209 of the impeller 208 is extended to reach into the stator 204. The extended rotational shaft 209 is rotatably mounted in the stator 204 via the bearings 211, 211.

Accordingly, when the impeller housing 203, the stator 204, and the nozzle 205 are separated from each other, the impeller 208 and the stator 204 are integrally separated from the impeller housing 203 or the nozzle 205.

As a result, the impeller 208 is removed from the impeller housing 203 and exposed.

It is therefore an object of the present invention to provide a water jet propeller that prevents the impeller from being exposed when the water jet propeller is disassembled.

SUMMARY AND OBJECTS OF THE INVENTION

To achieve the foregoing object, according to a first aspect of the present invention, there is provided a water jet propeller including: a cylindrically shaped impeller housing disposed in a rear portion of a hull; an impeller disposed inside the impeller housing; a cylindrically shaped stator disposed at a rear-end portion of the impeller housing; and a nozzle disposed at a rear-end portion of the stator, the nozzle having a diameter that gradually diminishes rearwardly. The water jet propeller propels the hull by expelling a water jet from a rear-end portion of the nozzle by rotating the impeller. The water jet propeller is characterized in the following points. Specifically, the impeller is rotatably mounted to the stator, being disposed inside the impeller housing; the impeller housing, the stator, and the nozzle are connected integrally with each other using a first bolt; and the impeller housing and the stator are connected integrally with each other using a second bolt.

The impeller is rotatably mounted to the stator and disposed inside the impeller housing. Further, the impeller housing and the stator are connected integrally with each other using the second bolt.

Accordingly, the impeller housing and the stator are kept in a state of being connected to each other when the first bolt is removed. This keeps the impeller housed inside the impeller housing, preventing the impeller from being exposed.

According to a second aspect of the present invention, the water jet propeller is characterized in that a head portion of the first bolt is disposed to face rearwardly of the hull and that a head portion of the second bolt is disposed to face forwardly of the hull.

The head portion of the first bolt is disposed to face rearwardly of the hull. This arrangement allows a removal tool to be simply mounted onto the head portion of the first bolt from a rearward direction of the hull. The first bolt can thus be removed and reinstalled simply and in a trouble-free manner.

The head portion of the second bolt is disposed to face forwardly of the hull. This arrangement makes the head portion of the second bolt invisible from the rear when the removal tool is mounted on the head portion of the first bolt from the rearward direction of the hull.

The arrangement, in which the head portion of the second bolt is invisible from the rear, prevents the second bolt from being inadvertently removed.

According to a third aspect of the present invention, the water jet propeller is characterized in the following points. Specifically, the stator includes a water take-out path, through which water in the stator is taken out externally, disposed on an outer wall of the stator; the impeller housing includes a water guide path in communication with the water take-out path, the water guide path being disposed on an outer wall of the impeller housing; a first protruding tab and a second protruding tab are disposed on a wall portion forming the water take-out path and a wall portion forming the water guide path, respectively, so as to oppose to each other; and the first and the second protruding tabs are connected together using the second bolt.

The first protruding tab and the second protruding tab are disposed on the wall portion forming the water take-out path and the wall portion forming the water guide path, respectively, so as to oppose to each other. The second bolt is mounted in the first and the second protruding tabs.

Accordingly, a connection portion between the water take-out path and the water guide path can be positively sealed via the first and the second protruding tabs by tightening the first and the second protruding tabs with the second bolt.

The first aspect of the present invention achieves the effect of preventing the impeller from being exposed.

According to the second aspect of the present invention, the head portion of the second bolt is not visible from the rear. This achieves the effect of preventing the second bolt from being inadvertently removed.

According to the third aspect of the present invention, the connection portion between the water take-out path and the water guide path can be positively sealed via the first and the second protruding tabs. This achieves the effect of efficiently taking out water in the stator externally.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A specific embodiment to which the present invention is applied will be described below with reference to the accompanying drawings. For the purpose of this specification, "front," "rear," "left," and "right" denote corresponding directions as viewed from an operator of a watercraft. In addition, "Fr" denotes forward, "Rr" denotes rearward, "L" denotes leftward, and "R" denotes rightward.

Figure 1:
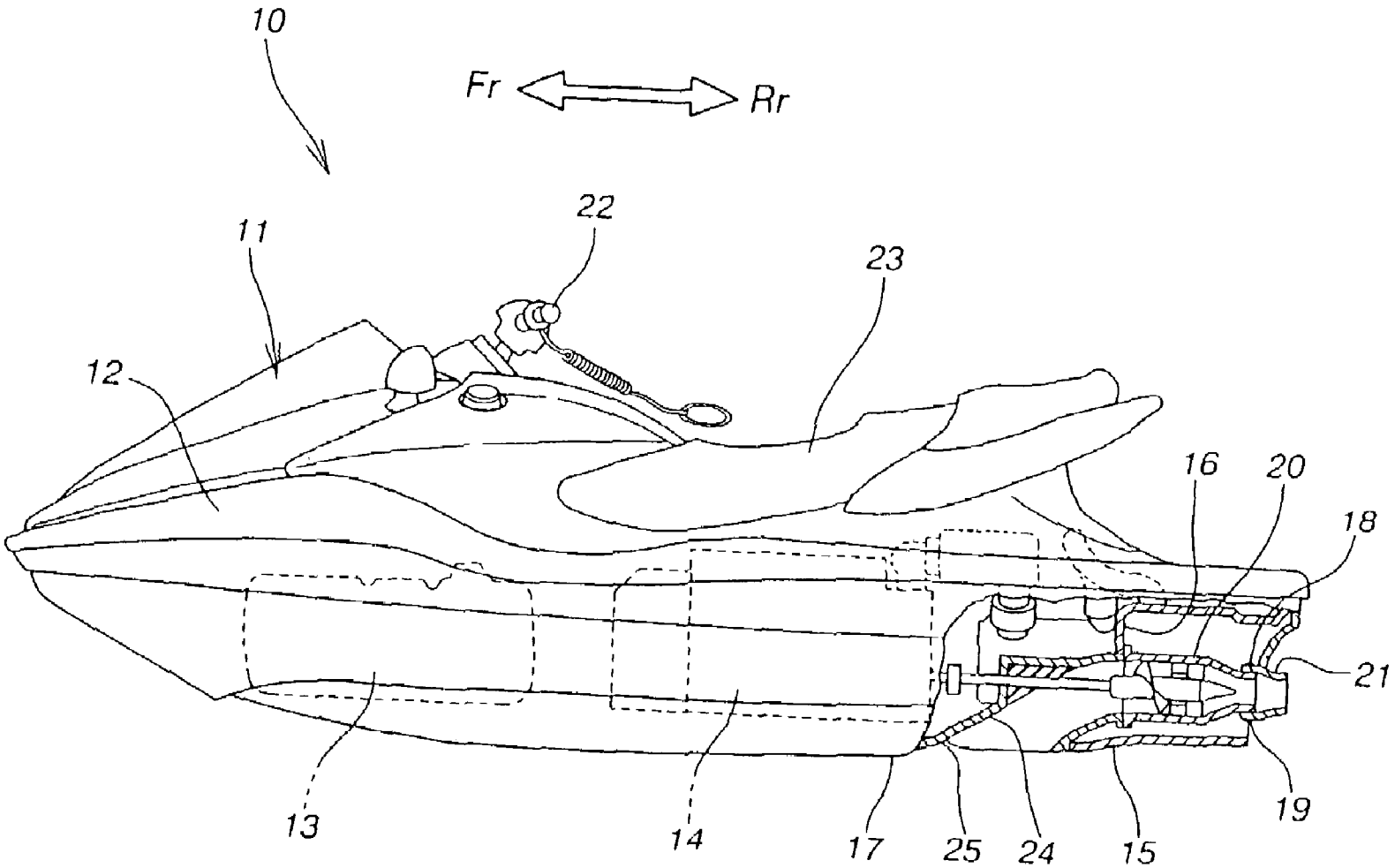
FIG. 1 is a side elevational view showing a personal watercraft including a water jet propeller according to a preferred embodiment of the present invention.

FIG. 1 is a side elevational view showing a personal watercraft including a water jet propeller according to a preferred embodiment of the present invention.

A personal watercraft 10 includes a fuel tank 13, an engine 14, a water jet propeller chamber 16, and a water jet propeller 20. The fuel tank 13 is mounted in a front portion 12 of a hull 11. The engine 14 is disposed rearward of the fuel tank 13. The water jet propeller chamber 16 is disposed at a stern (a rear portion of the hull) 15 located rearward of the engine 14. The water jet propeller 20 is disposed inside the water jet propeller chamber 16.

The personal watercraft 10 further includes a steering nozzle 21, a steering handlebar 22, and a seat 23. The steering nozzle 21 is disposed rearward of the water jet propeller 20 and mounted swingably to the right and left via upper and lower pins 18, 19. The steering handlebar 22 for swingably operating the steering nozzle 21 is disposed upward of the fuel tank 13. The seat 23 is disposed rearward of the steering handlebar 22.

Figure 2:
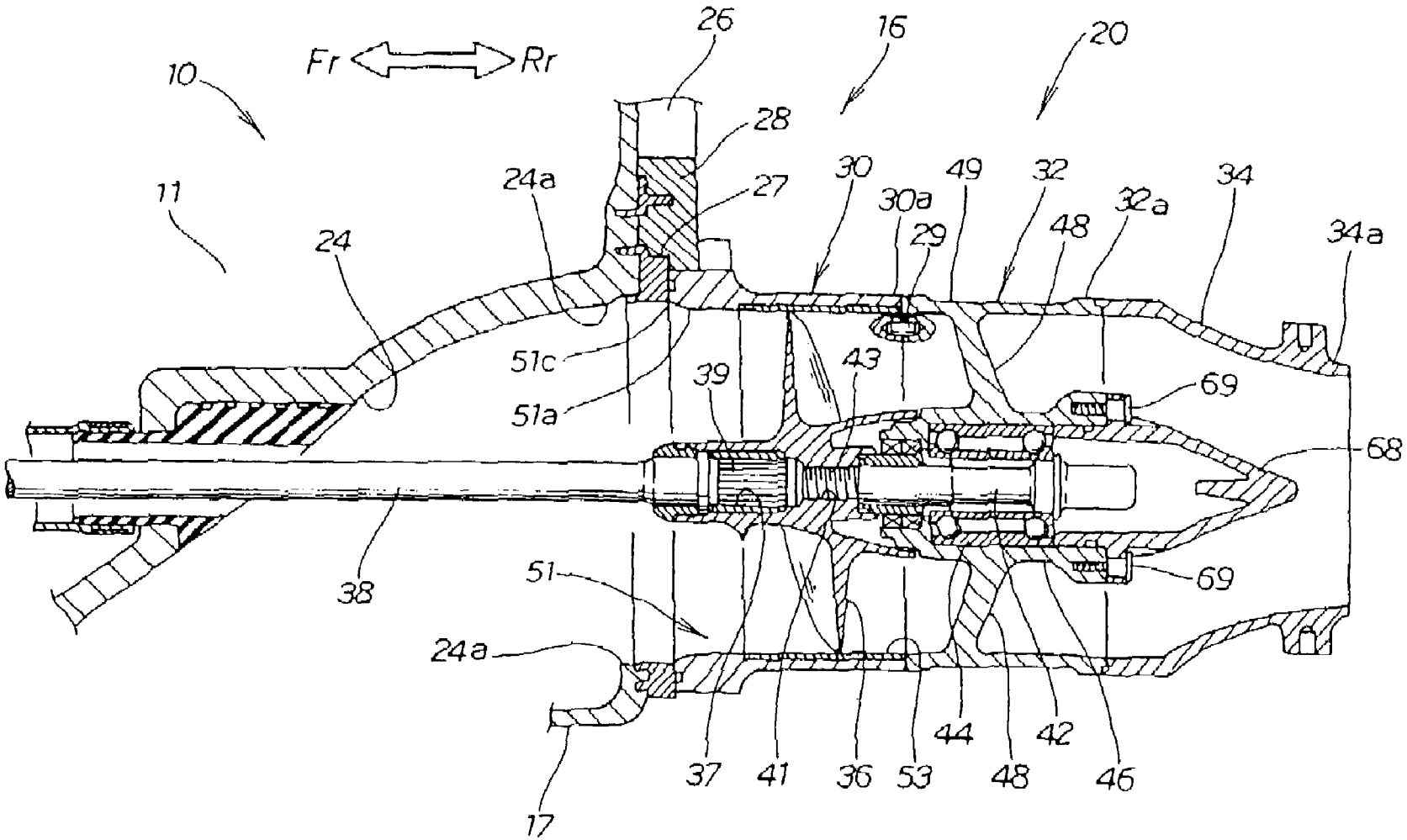
FIG. 2 is a cross-sectional view showing the water jet propeller according to the preferred embodiment of the present invention.

FIG. 2 is a cross-sectional view showing the water jet propeller according to the preferred embodiment of the present invention.

The water jet propeller 20 is constructed as follows. Specifically, the stem 15 of the hull 11 includes an intake port 25 (shown in FIG. 1) of a water flow duct 24 that opens to a hull bottom 17. The water flow duct 24 is extended to the water jet propeller chamber 16. First and second bases 27, 28 are mounted in a wall portion 26 of the water jet propeller chamber 16. A cylindrical impeller housing 30 is disposed on the first and the second bases 27, 28. A cylindrical stator 32 is disposed on a rear-end portion 30*a* of the impeller housing 30. Further, a nozzle 34 is disposed at a rear-end portion 32*a* of the stator 32. The nozzle 34 has a diameter that gradually diminishes rearwardly.

Further, an impeller 36 is disposed inside the impeller housing 30. Female splines 37 of the impeller 36 are engaged onto male splines 39 of a drive shaft 38 to achieve a splined coupling between the impeller 36 and the drive shaft 38. A front-end of the drive shaft 38 is coupled to the engine 14 (see FIG. 1). A threaded connection is then made between internal threads 41 of the impeller 36 and external threads 43 of a support shaft 42. The support shaft 42 is rotatably mounted in a bearing 46 of the stator 32 via a bearing 44.

More specifically, the impeller 36 and the support shaft 42 are integrated with each other by making the threaded connection between the internal threads 41 of the impeller 36 and the external threads 43 of the support shaft 42.

The arrangement, in which the support shaft 42 is rotatably mounted in the bearing 46 of the stator 32 via the bearing 44, means that the impeller 36 is rotatably mounted in the stator 32.

The impeller 36 is disposed, or accommodated, in the impeller housing 30.

The bearing 46 is secured to a casing 49 of the stator 32 via a plurality of stays 48 . . . ( . . . indicates plurality).

A cap 68 is mounted to a rear-end portion of the bearing 46 with bolts 69 . . . .

The stays 48 are members extending radially from an outer periphery of the bearing 46 to the casing 49 of the stator 32.

Figure 3:
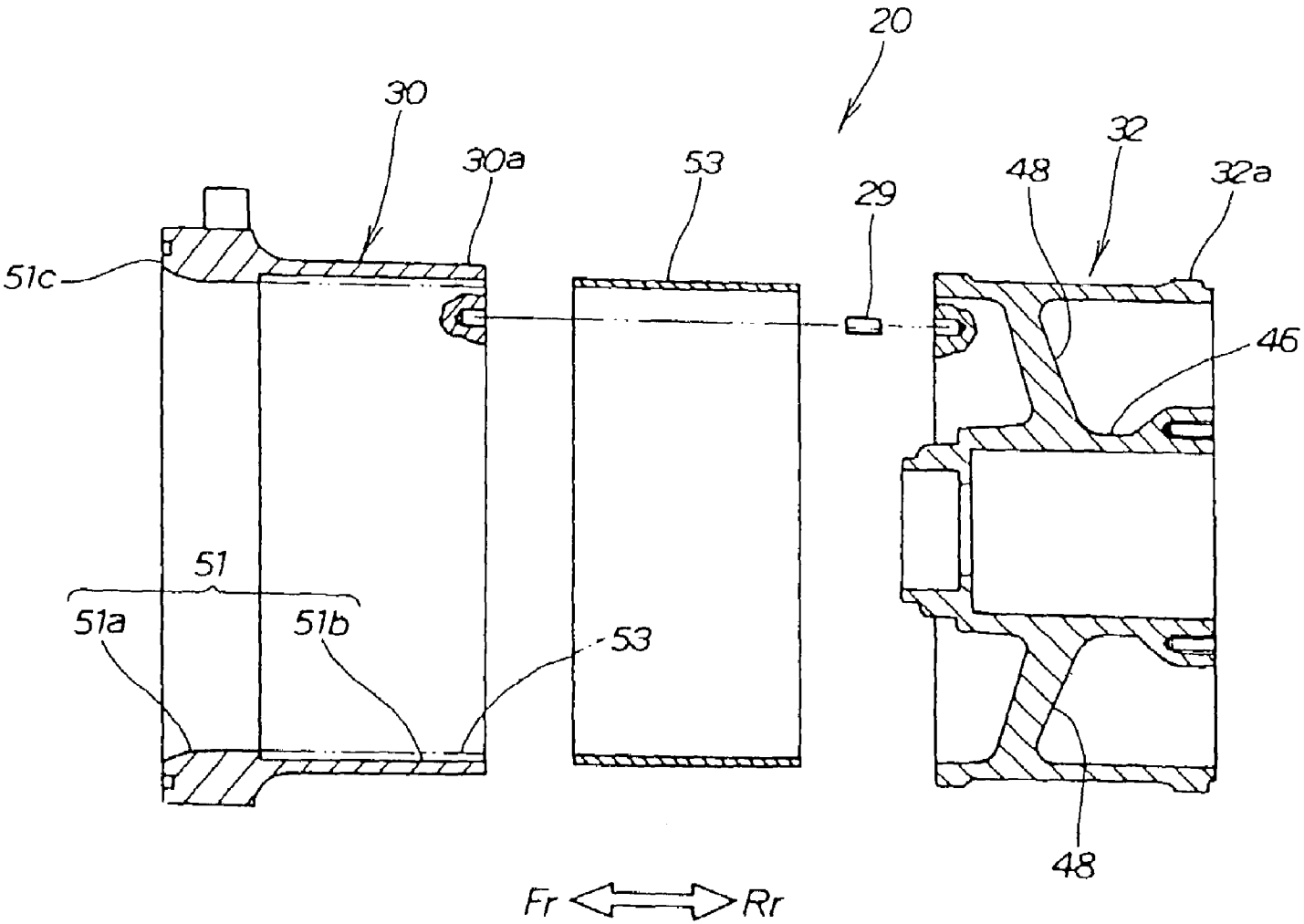
FIG. 3 is a cross-sectional view showing an impeller housing, a liner, and a stator of the water jet propeller according to the preferred embodiment of the present invention.

FIG. 3 is a cross-sectional view showing disassembled states of the impeller housing, a liner, and the stator of the water jet propeller according to the preferred embodiment of the present invention. An imaginary line representing a liner 53 in FIG. 3 indicates a state, in which the liner 53 is insert-molded in the impeller housing 30.

In the water jet propeller 20, the impeller 36 (see FIG. 2) is disposed so as to circumvent a front-end portion 51*a* of an inner periphery 51 of the impeller housing 30. Further, the liner 53 is disposed over a region 51*b* facing the impeller 36 and representing the inner periphery 51 of the impeller housing 30 less the front-end portion 51*a*. The front-end portion 51*a* is formed to have an inside diameter that gradually increases forwardly, or toward the front edge 51*c*.

By gradually increasing the inside diameter of the front-end portion 51*a* toward the front edge 51*c*, the front-end portion 51*a* is formed into a curved cross section.

By gradually increasing the inside diameter of the front-end portion 51*a* toward the front edge 51*c* as described above, the front edge 51*c* of the inner periphery 51 is formed to have the same inside diameter as the first base 27 shown in FIG. 2. The first base 27 has an inside diameter identical to the inside diameter of a rear-end portion 24*a* of the water flow duct 24.

According, the front edge 51*c* of the inner periphery 51 has an inside diameter identical to the inside diameter of the rear-end portion 24*a* of the water flow duct 24.

The liner 53 is, as an example, a stainless steel cylindrical member molded (insert-molded) in the impeller housing 30.

A positioning pin 29 is used when the rear-end portion 30*a* of the impeller housing 30 is mounted to the stator 32. A job of assembling the stator 32 to the impeller housing 30 is thereby simplified.

Referring back to FIG. 2, according to the water jet propeller 20, the impeller 36 is rotated by rotating the drive shaft 38 with the engine 14 (see FIG. 1).

Rotation of the impeller 36 allows water to be drawn into the water flow duct 24 through the intake port 25 (see FIG. 1). The water thus drawn in is then further drawn into the impeller housing 30 via the rear-end portion 24*a* of the water flow duct 24.

Water in the impeller housing 30 is sent to the nozzle 34 via the stator 32 through rotation of the impeller 36. A water jet is then expelled from a rear-end portion 34*a* of the nozzle 34 rearwardly as shown by an arrow b.

Expelling the water jet rearwardly from the rear-end portion 34*a* of the nozzle 34 propels the personal watercraft 10 (shown in FIG. 1).

Figure 4:
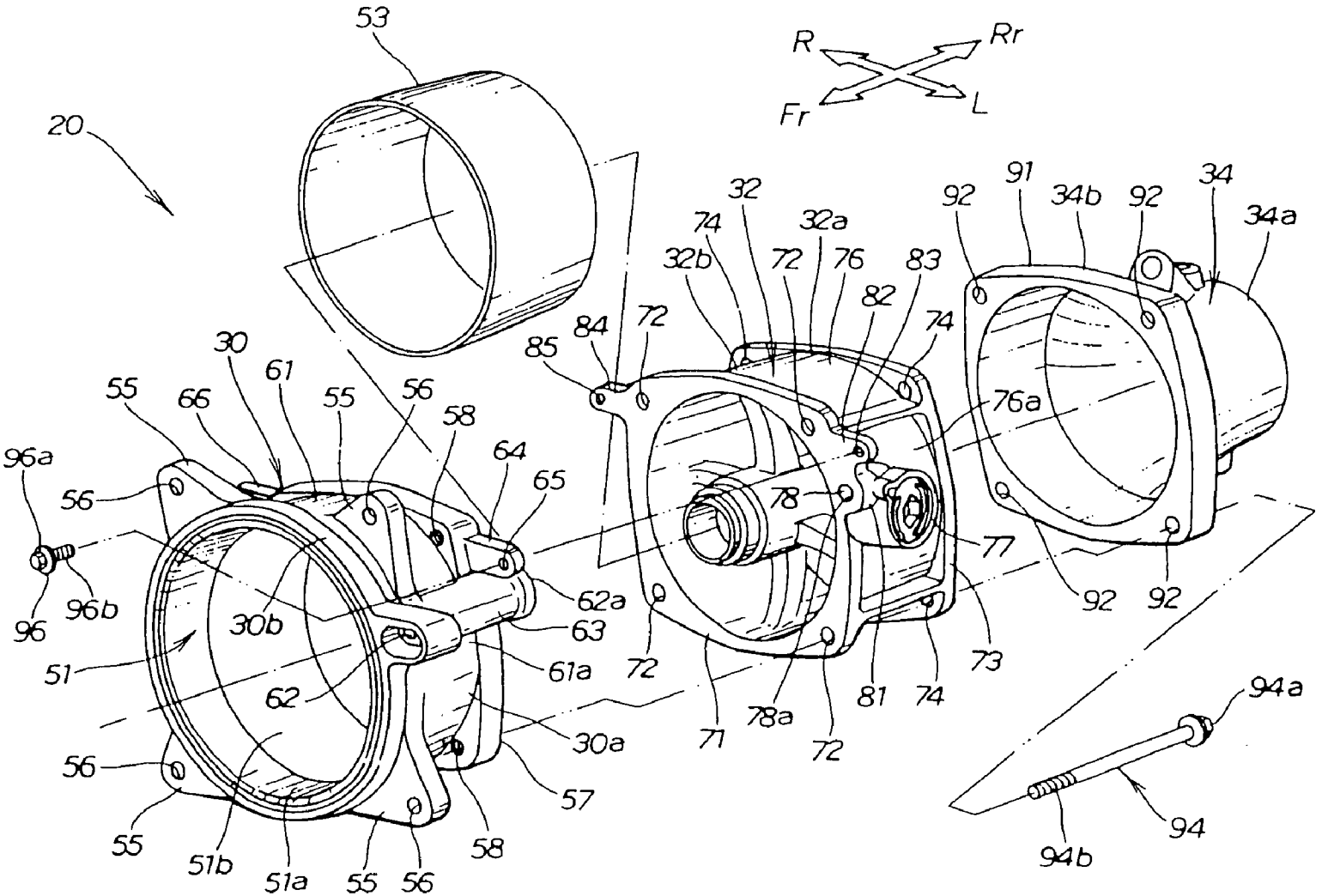
FIG. 4 is an exploded perspective view showing the water jet propeller according to the preferred embodiment of the present invention.

FIG. 4 is an exploded perspective view showing the water jet propeller according to the preferred embodiment of the present invention.

The impeller housing 30 is a cylindrically formed member. Four mounting brackets 55 . . . are provided at predetermined intervals on a front-end portion 30*b*. Each of the mounting brackets 55 . . . is provided with a mounting hole 56. A rear flange 57 is formed on the rear-end portion 30*a*. Mounting threaded holes 58 . . . (shown in FIG. 4 are only the left-hand side mounting threaded holes 58, 58) are formed at all four corners of the rear flange 57.

The impeller housing 30 is constructed as follows. Specifically, a left-hand side portion 61*a* of an outer wall 61 includes a water guide path 62. A wall portion 63 forming the water guide path 62 includes a left-hand side second protruding tab (a second protruding tab) 64. The left-hand side second protruding tab 64 includes a mounting hole 65. A right-hand side portion (not shown) of the outer wall 61, or a side opposite to the left-hand side second protruding tab 64, includes a right-hand side second protruding tab 66 (see FIG. 6). The right-hand side second protruding tab 66 includes a mounting hole 67 (see FIG. 6).

The liner 53 is, as an example, a stainless steel cylindrical member molded (insert-molded) in the impeller housing 30 when the impeller housing 30 is cast.

Forming the liner 53 from the stainless steel that offers outstanding wear resistance helps prevent the inner periphery 51 of the impeller housing 30 from wearing should foreign matter enter between the impeller 36 and the impeller housing 30 during rotation of the impeller 36 (see FIG. 2).

The stator 32 is a cylindrically formed member. A front-end portion 32*b* includes a front flange 71. The front flange 71 is provided with mounting holes 72 . . . disposed at all four corners thereof. The rear-end portion 32*a* of the stator 32 includes a rear flange 73. The rear flange 73 is provided with mounting holes 74 . . . (the mounting hole 74 at the right bottom corner is not shown) disposed at all four corners thereof.

The mounting holes 72 . . . in the front flange 71 and the mounting holes 74 . . . in the rear flange 73 are formed concentrically with each other.

The stator 32 is constructed as follows. Specifically, a left-hand side portion 76*a* of an outer wall 76 includes a water take-out portion 77. The water take-out portion 77 is provided with a water take-out path 78. A wall portion 81 forming the water take-out path 78 includes a left-hand side first protruding tab (a first protruding tab) 82. The left-hand side first protruding tab 82 is provided with a mounting threaded hole 83. A right-hand side portion (not shown) of the outer wall 76, or a side opposite to the left-hand side first protruding tab 82, includes a right-hand side first protruding tab 84 (see also FIG. 6). The right-hand side first protruding tab 84 includes a mounting threaded hole 85 (see also FIG. 6).

The left-hand side first protruding tab 82 is disposed opposingly to the left-hand side second protruding tab 64. The right-hand side first protruding tab 84 is disposed opposingly to the right-hand side second protruding tab 66 (see FIG. 6).

The water take-out path 78 is a path, through which water in the stator 32 is taken out externally via the water take-out portion 77 and then guided into the water guide path 62.

The water guided up to the water guide path 62 is guided to the engine through a path not shown, used as coolant for cooling the engine.

There are known some types of the water jet propeller 20 that integrate the impeller housing 30 with the stator 32. When the impeller housing 30 is molded integrally with the stator 32, the resultant molded member becomes relatively large in size and has a complicated shape.

Accordingly, integrally molding the impeller housing 30 with the stator 32 requires a mold that is large in size and complicated in shape, thus resulting in equipment cost being increased.

The impeller housing 30 and the stator 32 are therefore divided into two parts so that each of the members 30, 32 is built compactly and shaped simply.

It is then possible to make molds for molding the impeller housing 30 and the stator 32 small and less complicated in shape, thus suppressing the equipment cost.

The nozzle 34 is attached to the rear-end portion 32*a* of the stator 32.

The nozzle 34 is formed to have a diameter that gradually diminishes from a front-end portion 34*b* toward the rear-end portion 34*a*. The front-end portion 34*b* includes a front flange 91. The front flange 91 is provided with mounting holes 92 . . . disposed at all four corners thereof.

The front-end portion 32*b* of the stator 32 is pressed up against the rear-end portion 30*a* of the impeller housing 30. The mounting holes 72 . . . in the front flange 71 are thereby aligned with corresponding ones of the mounting threaded holes 58 . . . in the rear flange 57.

Further, pressing the front-end portion 32*b* of the stator 32 up against the rear-end portion 30*a* of the impeller housing 30 results in the following. Specifically, a rear opening end 62*a* of the water guide path 62 is connected to an opening end 78*a* of the water take-out path 78, thus bringing the water guide path 62 into communication with the water take-out path 78. At the same time, the left-hand side second protruding tab 64 is abutted against the left-hand side first protruding tab 82, and the right-hand side second protruding tab 66 (see FIG. 6) is abutted against the right-hand side first protruding tab 84.

Similarly, the front-end portion 34*b* of the nozzle 34 is pressed up against the rear-end portion 32*a* of the stator 32. The mounting holes 92 in the front flange 91 are then aligned with corresponding ones of the mounting holes 74 in the rear flange 73.

Connection bolts (first bolts) 94 . . . are then inserted into the mounting holes 92 . . . in the front flange 91, the mounting holes 74 in the rear flange 73, the mounting holes 72 . . . in the front flange 71, and the mounting threaded holes 58 . . . in the rear flange 57.

The connection bolt 94 includes a head portion 94*a* disposed at a base end portion and a threaded portion 94*b* at a leading end portion. The threaded portion 94*b* has external threads that can be screw-threadably engaged with the mounting threaded hole 58.

The left-hand side second protruding tab 64 is abutted against the left-hand side first protruding tab 82. The mounting threaded hole 83 in the left-hand side first protruding tab 82 is thereby aligned with the mounting hole 65 in the left-hand side second protruding tab 64.

A lock bolt 96 is then inserted in the mounting hole 65 in the left-hand side second protruding tab 64 and the mounting threaded hole 83 in the left-hand side first protruding tab 82.

The lock bolt 96 includes a head portion 96*a* disposed at a base end portion and a threaded portion 96*b* at a leading end portion. The threaded portion 96*b* has external threads that can be screw-threadably engaged with the mounting threaded hole 83.

Figure 5:
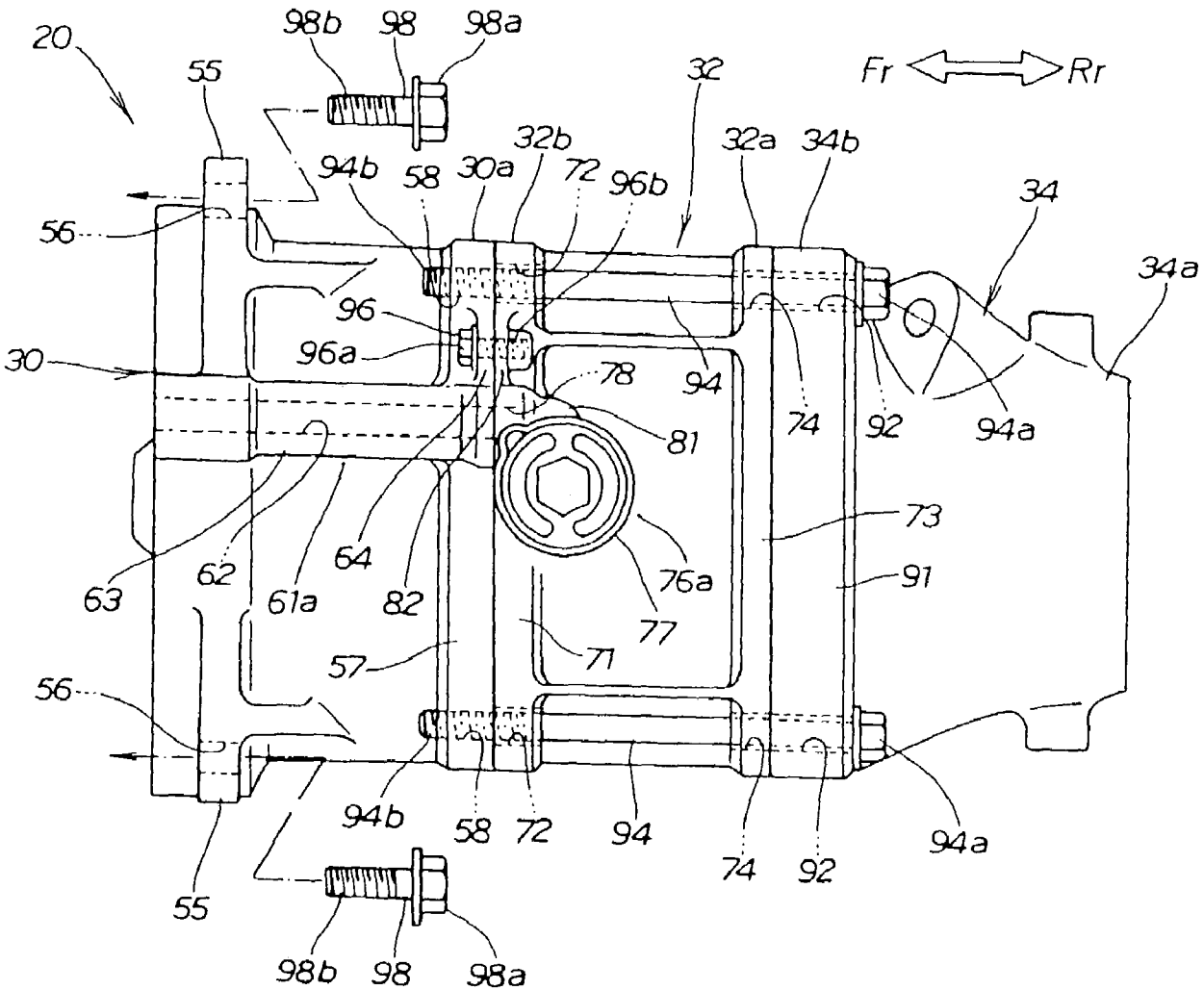
FIG. 5 is a side elevational view showing the water jet propeller according to the preferred embodiment of the present invention.
Figure 6:
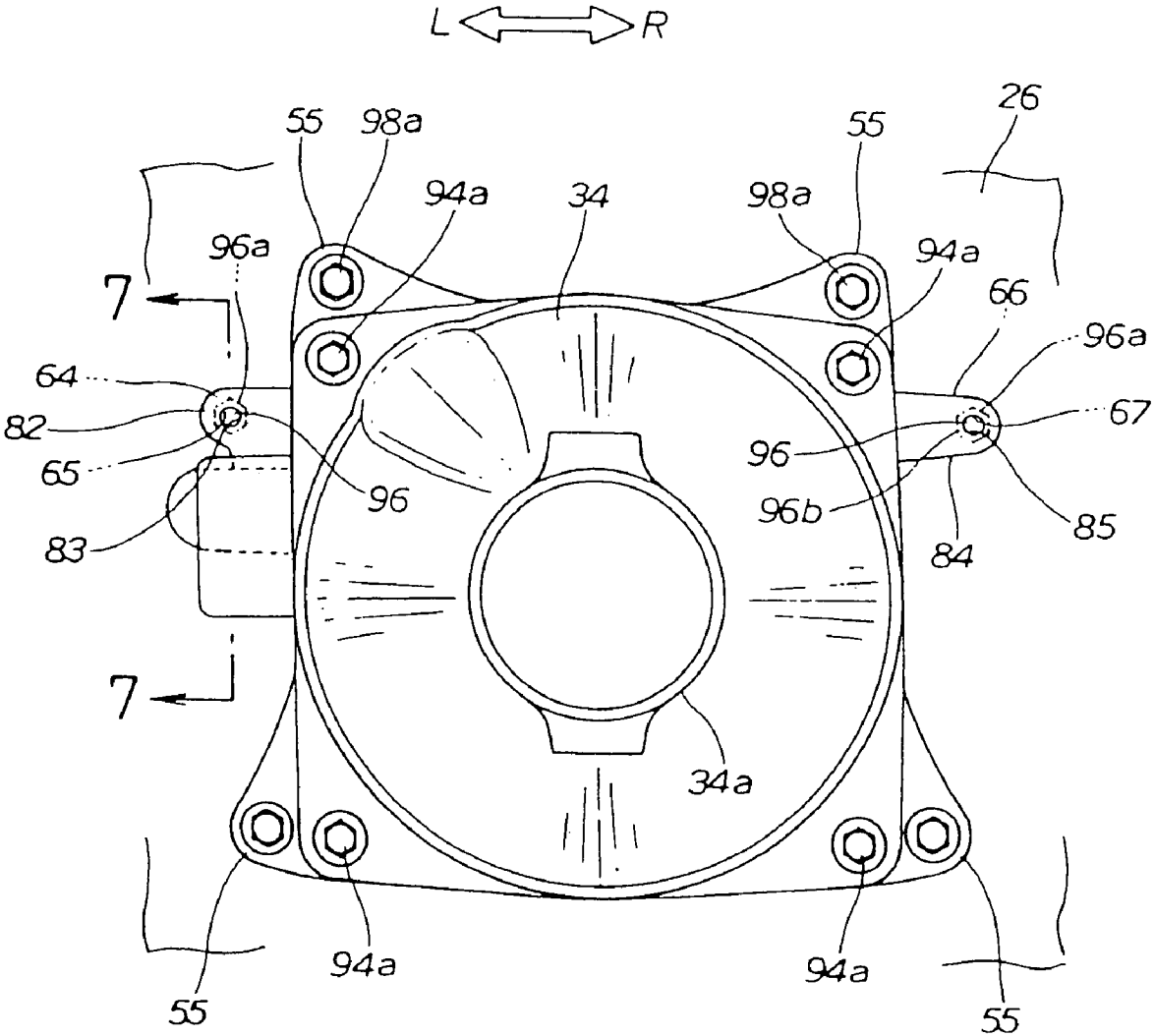
FIG. 6 is a rear view showing the water jet propeller according to the preferred embodiment of the present invention.

FIG. 5 is a side elevational view showing the water jet propeller according to the preferred embodiment of the present invention. FIG. 6 is a rear view showing the water jet propeller according to the preferred embodiment of the present invention.

The front-end portion 32*b* of the stator 32 is pressed up against the rear-end portion 30*a* of the impeller housing 30. Further, the front-end portion 34*b* of the nozzle 34 is pressed up against the rear-end portion 32*a* of the stator 32.

In this condition, the connection bolts 94 . . . are inserted into the mounting holes 92 . . . in the nozzle 34, the mounting holes 74 . . . and the mounting holes 72 in the stator 32, and the mounting threaded holes 58 . . . in the impeller housing 30.

The threaded portions 94*b* . . . of the connection bolts 94 . . . are then screwed in the corresponding ones of the mounting threaded holes 58 . . . .

The stator 32 is thereby clamped between the impeller housing 30 and the nozzle 34. The impeller housing 30, the stator 32, and the nozzle 34 are then connected together using the four connection bolts 94 . . . .

In this condition, the head portions 94*a* of the connection bolts 94 . . . are disposed to face rearwardly of the hull 11 (see FIG. 1).

Connecting together the impeller housing 30, the stator 32, and the nozzle 34 brings the water guide path 62 into communication with the water take-out path 78.

In addition, connecting together the impeller housing 30, the stator 32, and the nozzle 34 causes the left-hand side first protruding tab 82 and the left-hand side second protruding tab 64 to oppose each other. Similarly, connecting together the impeller housing 30, the stator 32, and the nozzle 34 causes the right-hand side first protruding tab 84 and the right-hand side second protruding tab 66 (see FIG. 6) to oppose each other.

The lock bolt (second bolt) 96 is inserted in the mounting hole 65 (see FIG. 7) in the left-hand side second protruding tab 64. The threaded portion 96*b* protruding from the left-hand side second protruding tab 64 is then screw-threadably engaged with the mounting threaded hole 83 (see FIG. 7) in the left-hand side first protruding tab 82.

Specifically, the left-hand side first protruding tab 82 and the left-hand side second protruding tab 64 are connected together with the lock bolt 96.

Further, referring to FIG. 6, the lock bolt (second bolt) 96 is inserted in the mounting hole 67 in the right-hand side second protruding tab 66. The threaded portion 96*b* protruding from the right-hand side second protruding tab 66 is then screw-threadably engaged with the mounting threaded hole 85 in the right-hand side first protruding tab 84.

Specifically, the right-hand side first protruding tab 84 and the right-hand side second protruding tab 66 are connected together with the lock bolt 96.

Thus, the left-hand side first protruding tab 82 and the left-hand side second protruding tab 64 are connected together with the lock bolt 96, and the right-hand side first protruding tab 84 and the right-hand side second protruding tab 66 are connected together with the lock bolt 96. The impeller housing 30 and the stator 32 are thereby connected together with the two lock bolts 96, 96.

In this condition, the head portions 96*a*, 96*a* of the lock bolts 96, 96 are disposed to face forwardly of the hull 11 (see FIG. 1).

Reasons why the impeller housing 30 and the stator 32 are connected together with the two lock bolts 96, 96 will be described later in detail with reference to FIGS. 8 and 9.

In a condition, in which the impeller housing 30, the stator 32, and the nozzle 34 are integrated together, the mounting brackets 55 . . . of the impeller housing 30 are pressed against the first and the second bases 27, 28 (see FIG. 2). Mounting bolts 98 . . . are then inserted in the mounting holes 56 . . . in the mounting brackets 55 . . . .

Threaded portions 98*b* . . . of the mounting bolts 98 . . . protruding from the mounting brackets 55 . . . are then screw-threadably engaged with threaded holes (not shown) in the first and the second bases 27, 28.

The impeller housing 30, the stator 32, and the nozzle 34 are thereby mounted to the first and the second bases 27, 28 with the mounting bolts 98 . . . .

In this condition, the mounting bolts 98 . . . are disposed such that head portions 98*a* thereof face rearwardly of the hull 11 (see FIG. 1).

The head portions 94*a* . . . of the connection bolts 94 . . . are disposed to face rearwardly of the hull 11 (see FIG. 1).

This arrangement allows the connection bolts 94 . . . to be removed and reinstalled simply and in a trouble-free manner by simply attaching a removal tool onto the head portions 94*a* . . . of the connection bolts 94 . . . from a rearward direction of the hull 11.

Similarly, the head portions 98*a* . . . of the mounting bolts 98 . . . are disposed to face rearwardly of the hull 111 (see FIG. 1).

This arrangement allows the mounting bolts 98 . . . to be removed and reinstalled simply and in a trouble-free manner by simply attaching a removal tool onto the head portions 98*a* . . . of the mounting bolts 98 . . . from a rearward direction of the hull 11.

Similarly, the head portions 96*a*, 96*a* of the lock bolts 96, 96 are disposed to face forwardly of the hull 11 (see FIG. 1).

This arrangement makes the head portions 96*a*, 96*a* of the lock bolts 96, 96 invisible from the rear when the removal tool is mounted on the head portions 94*a* . . . of the connection bolts 94 . . . or the head portions 98*a* . . . of the mounting bolts 98 . . . from the rearward direction of the hull 11.

The arrangement, in which the head portions 96*a*, 96*a* of the lock bolts 96, 96 are invisible from the rear, prevents the lock bolts 96, 96 from being inadvertently removed.

Figure 7:
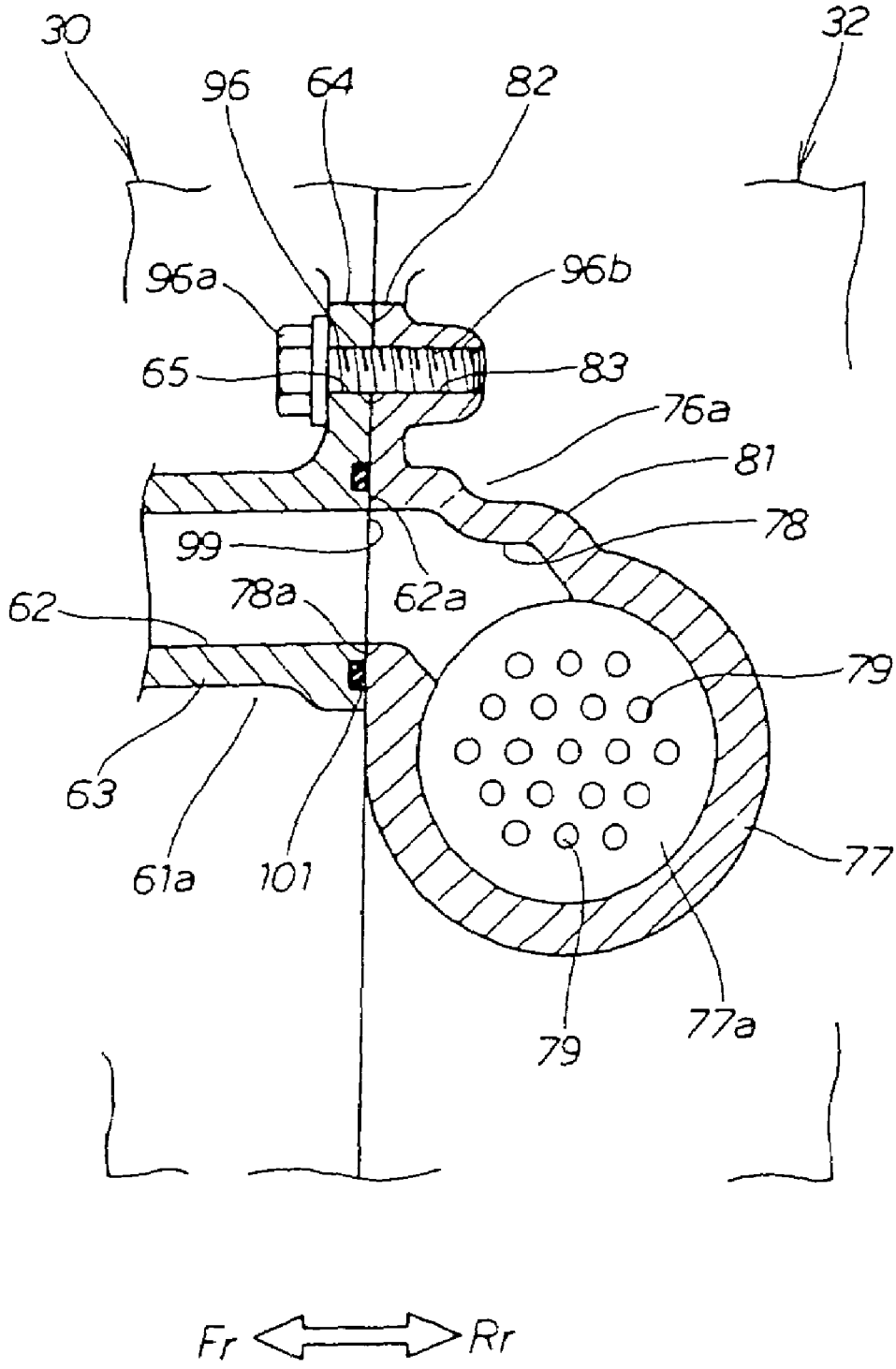
FIG. 7 is a cross-sectional view taken along line 7—7 of FIG. 6.

FIG. 7 is a cross-sectional view taken along line 7—7 of FIG. 6.

The lock bolt 96 is inserted in the mounting hole 65 in the left-hand side second protruding tab 64. The threaded portion 96*b* protruding from the left-hand side second protruding tab 64 is then screw-threadably engaged with the mounting threaded hole 83 in the left-hand side first protruding tab 82.

The lock bolt 96 is tightened with the left-hand side second protruding tab 64 being opposed to the left-hand side first protruding tab 82.

It should be noted herein that the left-hand side second protruding tab 64 is formed integrally with the wall portion 63 of the water guide path 62 and the left-hand side first protruding tab 82 is formed integrally with the wall portion 81 of the water take-out path 78.

Accordingly, the lock bolt 96 is tightened with the left-hand side second protruding tab 64 and the left-hand side first protruding tab 82 being opposed to each other. The lock bolt 96 is therefore tightened in a condition, in which the opening end 78*a* of the water take-out path 78 and the rear opening end 62*a* of the water guide path 62 are in abutment with each other by way of the left-hand side second protruding tab 64 and the left-hand side first protruding tab 82.

This achieves a positive sealing of an abutment portion (connection portion) 99 between the opening end 78*a* of the water take-out path 78 and the rear opening end 62*a* of the water guide path 62 using a sealing material 101.

The water take-out path 78 is in communication with a space 77*a* of the water take-out portion 77. The space 77*a* is in communication with the stator 32 via small holes 79 . . . .

Accordingly, water in the stator 32 is led into the space 77*a* via the small holes 79 . . . and the water led into the space 77*a* is guided to the water guide path 62 via the water take-out path 78.

The reasons why the impeller housing 30 and the stator 32 are connected together with the two lock bolts will be described in detail below with reference to FIGS. 8 and 9.

Figure 8:
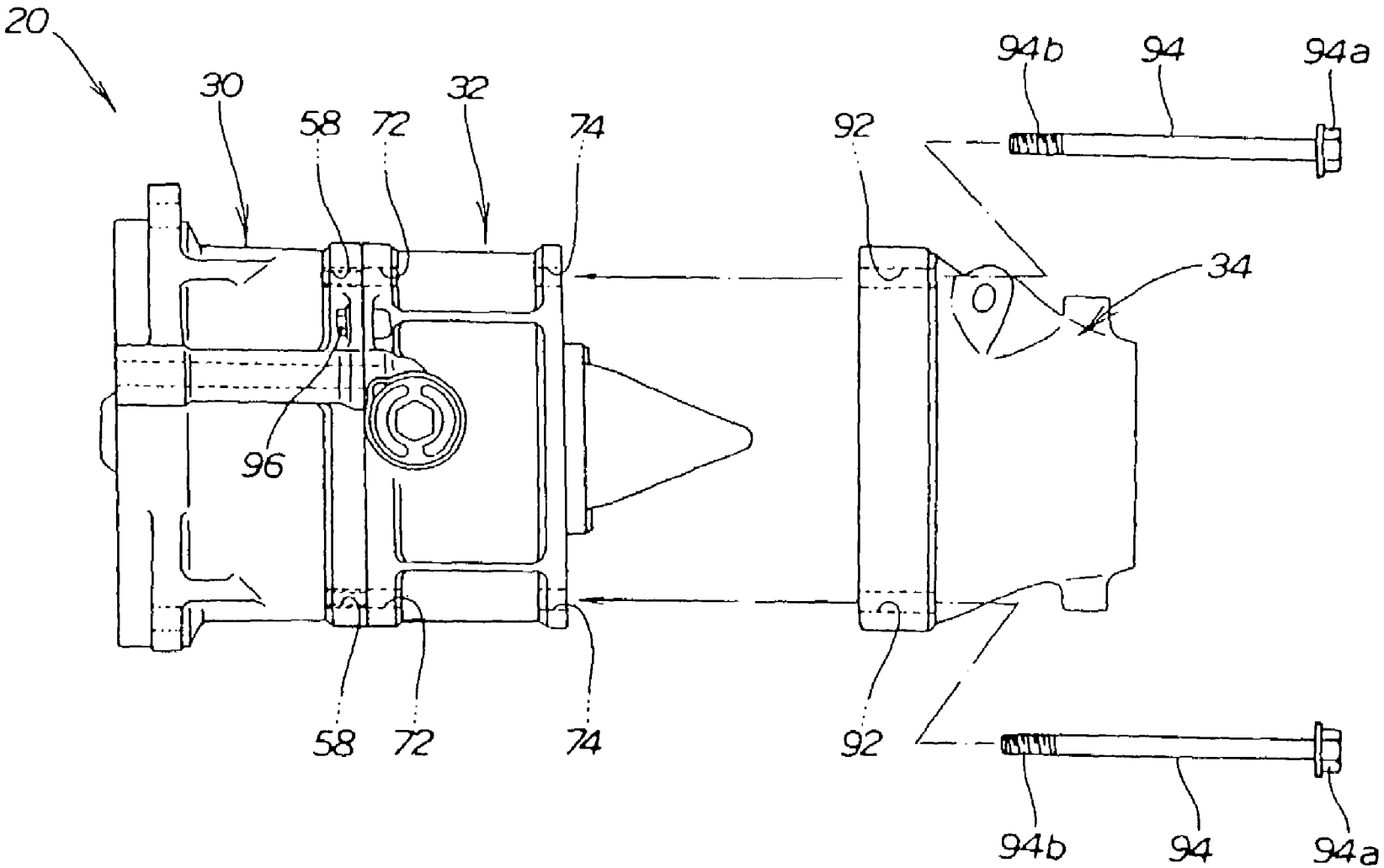
FIG. 8 is a view for illustrating a condition, in which connection bolts are removed from the water jet propeller according to the preferred embodiment of the present invention.

FIG. 8 is a view for illustrating a condition, in which the connection bolts are removed from the water jet propeller according to the preferred embodiment of the present invention.

A threaded connection is made between the impeller 36 of the water jet propeller 20 and the support shaft 42 (see FIG. 2). The support shaft 42 is then rotatably mounted in the stator 32. The impeller 36 is then accommodated in the impeller housing 30.

In this condition, the impeller housing 30 and the stator 32 are connected integrally using the lock bolts 96, 96.

Accordingly, when the connection bolts 94 . . . are removed to separate the water jet propeller 20, a condition, in which the impeller housing 30 and the stator 32 are connected together, is retained.

Accordingly, a condition, in which the impeller 36 is stored inside the impeller housing 30, is retained, thus preventing the impeller 36 from being exposed.

Figure 9:
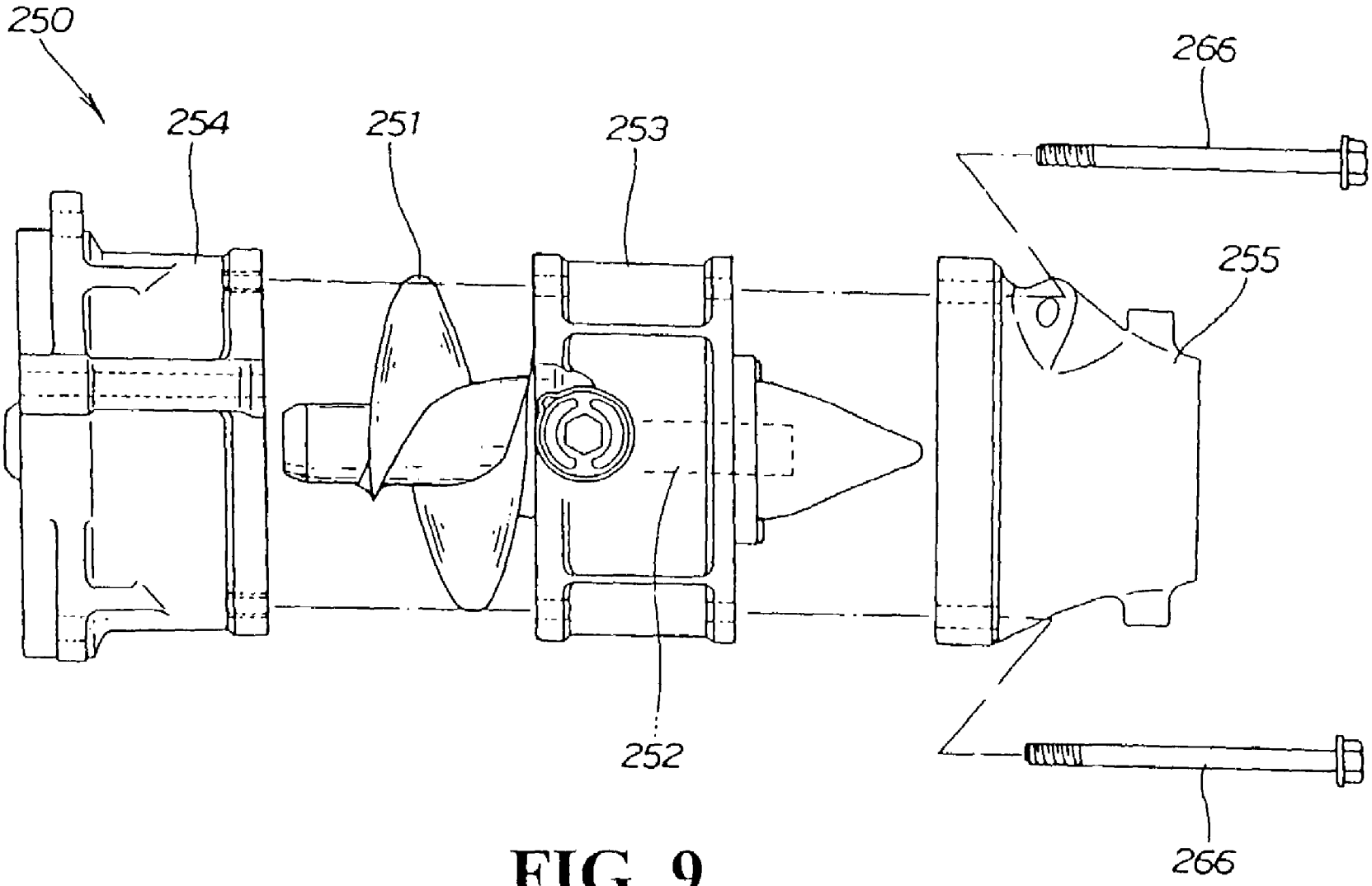
FIG. 9 is a view for illustrating a condition, in which connection bolts are removed from a water jet propeller according to a modified example of the present invention.

FIG. 9 is a view for illustrating a condition, in which connection bolts are removed from a water jet propeller according to a modified example of the present invention.

A threaded connection is made between an impeller 251 of a water jet propeller 250 and a support shaft 252. The support shaft 252 is then rotatably mounted in a stator 253. The impeller 251 is then accommodated in an impeller housing 254.

In this condition, the impeller housing 254, the stator 253, and a nozzle 255 are connected integrally together using connection bolts 266 . . . .

When the connection bolts 266 . . . are removed to separate the water jet propeller 250, therefore, the impeller housing 254 is separated from the stator 253.

As a result, the impeller housing 254 is separated from the impeller 251, thus exposing the impeller 251.

An example, in which the water jet propeller propels the personal watercraft, will be described with reference to FIG. 10.

Figure 10:
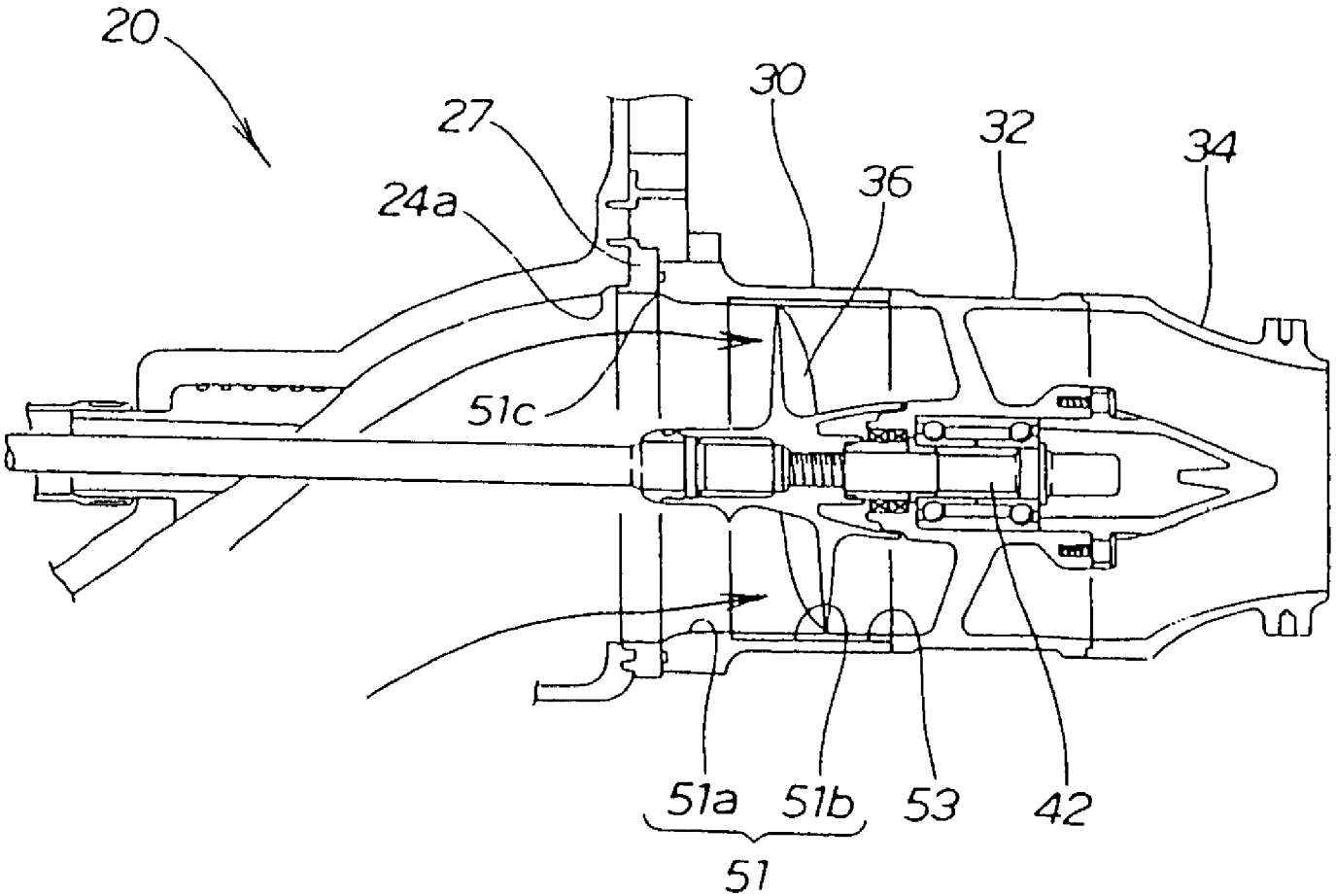
FIG. 10 is a view for illustrating the operation of the water jet propeller according to the preferred embodiment of the present invention.
Figure 11:
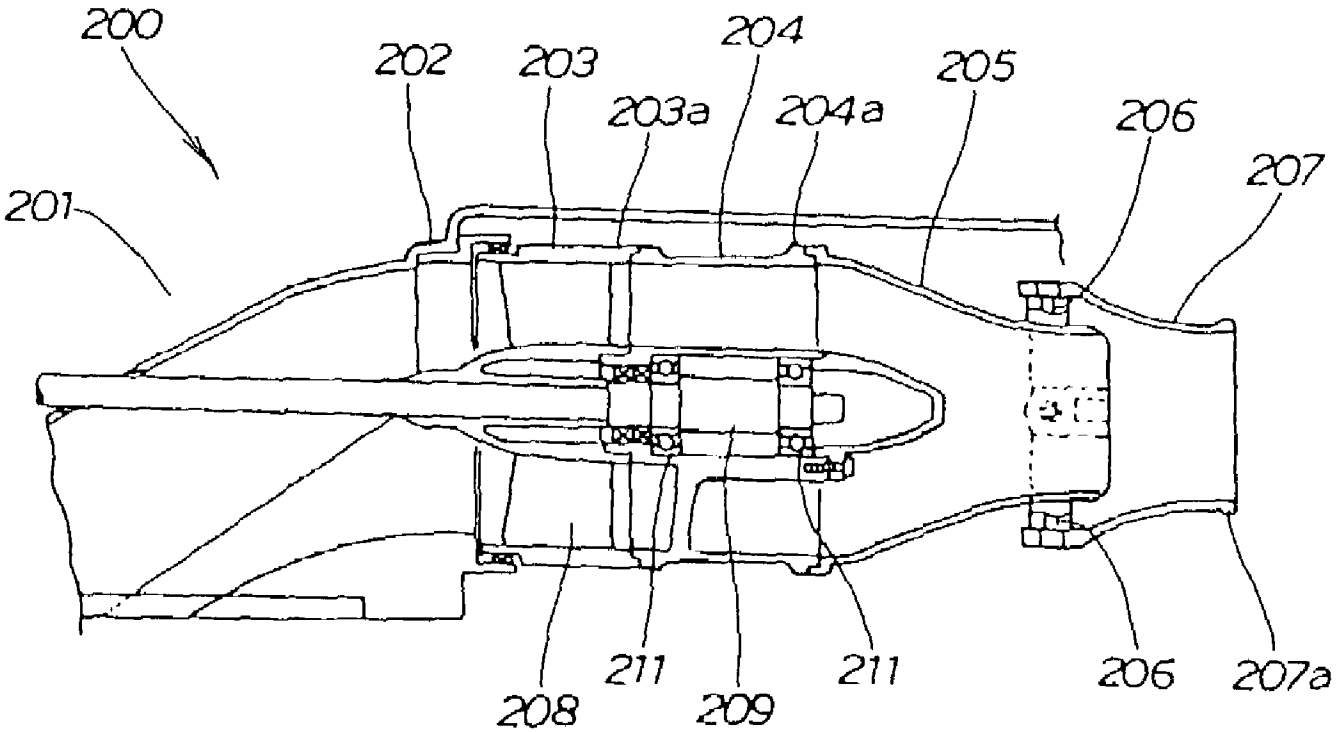
BACKGROUND ART FIG. 11
FIG. 11 is a view for illustrating a basic construction of a conventional water jet propeller.

FIG. 10 is a view for illustrating the operation of the water jet propeller according to the preferred embodiment of the present invention.

The water jet propeller 20 includes the liner 53 that is applied to the region 51*b* facing the impeller 36 and representing the inner periphery 51 of the impeller housing 30 less the front-end portion 51*a*. The inside diameter of the front-end portion 51*a* not lined with the liner 53 is made to increase gradually toward the front edge 51*c*. The front-end portion 51*a* is thus formed into a curved cross section.

The front edge 51*c* of the inner periphery 51 is formed to have an inside diameter identical to the inside diameter of the first base 27 and the inside diameter of the rear-end portion 24*a* of the water flow duct 24.

Accordingly, even if the inside diameter of the region 51*b* facing the impeller 36 and representing the inner periphery 51 of the impeller housing 30 less the front-end portion 51*a*, is made smaller than the inner periphery of the rear-end portion 24*a* of the water flow duct 24, there is produced no step in the first base 27, the rear-end portion 24*a* of the water flow duct 24, and the front edge 51*c* of the inner periphery 51.

This permits an efficient inflow of water in the direction shown by the arrow in FIG. 10 from the rear-end portion 24*a* of the water flow duct 24 to the impeller housing 30 by way of the first base 27 and the front-end portion 51*a* of the inner periphery 51.

It is easily conceivable that foreign matter (not shown) enters between the impeller 36 and the impeller housing 30 during rotation of the impeller 36.

The water jet propeller 20 therefore includes the stainless steel liner 53 that is applied to the region 51*b* facing the impeller 36 and representing the inner periphery 51 of the impeller housing 30 less the front-end portion 51*a*.

This enhances wear resistance of the region 51*b* facing the impeller 36 and representing the inner periphery 51 of the impeller housing 30 less the front-end portion 51*a*. It is also possible to suppress wear of the liner 53, should foreign matter (not shown) enter between the impeller 36 and the impeller housing 30.

The preferred embodiment of the present invention has been described using an exemplary case, in which four connection bolts 94 . . . are used to integrally connect the impeller housing 30, the stator 32, and the nozzle 34. It should be noted that the number of the connection bolts 94 . . . is not limited to four; rather, any number of the connection bolts 94 . . . may be used.

The preferred embodiment of the present invention has been described using an exemplary case, in which two lock bolts 96 . . . are used to integrally connect the impeller housing 30 and the stator 32. It should be noted that the number of the lock bolts 96 . . . is not limited to four; rather, any number of the lock bolts 96 . . . may be used.

Further, according to the preferred embodiment of the present invention described as an exemplary case in the foregoing, the water take-out path 78 is mounted to the left of the stator 32 and the water guide path 62 is mounted to the left of the impeller housing 30. It should be noted, however, that the positions at which the water take-out path 78 and the water guide path 62 are disposed at not limited to the exemplary case. Rather, the water take-out path 78 and the water guide path 62 may be disposed at any other locations.

The present invention can be preferably applied to a water jet propeller having an impeller housing disposed at a rear portion of a hull and making an impeller disposed inside the impeller housing rotate to expel a water jet.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water jet propeller, comprising:

a cylindrically shaped impeller housing disposed in a rear portion of a hull;

an impeller disposed inside the impeller housing;

a cylindrically shaped stator disposed at a rear-end portion of the impeller housing;

a cylindrical liner inserted into an inner periphery of the impeller housing; and a nozzle disposed at a rear-end portion of the stator, the nozzle having a diameter that gradually diminishes rearwardly;

the water jet propeller for propelling the hull by expelling a water jet from a rear-end portion of the nozzle by rotating the impeller;

wherein the impeller is rotatably mounted to the stator, being disposed inside the impeller housing;

wherein the impeller housing, the stator, and the nozzle are connected integrally with each other using a first bolt; and wherein the impeller housing and the stator are connected integrally with each other using a second bolt.

2. The water jet propeller according to claim 1, wherein a head portion of the first bolt is disposed to face rearwardly of the hull; and wherein a head portion of the second bolt is disposed to face forwardly of the hull.

3. The water jet propeller according to claim 1, further comprising a stainless steel liner inserted into an inner periphery of the impeller housing, the liner for preventing the inner periphery of the impeller housing from wearing should foreign matter enter between the impeller and the impeller housing 30 during rotation of the impeller.

4. The water jet propeller according to claim 1, wherein the first bolt passes through non-threaded holes in the stator and engages with threaded holes in the impeller housing.

5. The water jet propeller according to claim 1, wherein the impeller housing, the stator, and the nozzle being connecting together, brings a water guide path in the impeller housing into communication with a water take-out path in the stator.

6. The water jet propeller according to claim 1, wherein an inside diameter of a front-end portion of the impeller housing is made to increase gradually toward a front edge in order to have the inside diameter be identical to an inside diameter of the rear-end portion of a water flow duct.

7. The water jet propeller according to claim 1, further comprising a positioning pin between a rear-end portion of the impeller housing and the stator, for simplifying assembling the stator to the impeller housing.

8. A water jet propeller comprising:

a cylindrically shaped impeller housing disposed in a rear portion of a hull;

an impeller disposed inside the impeller housing;

a cylindrically shaped stator disposed at a rear-end portion of the impeller housing; and a nozzle disposed at a rear-end portion of the stator. the nozzle having a diameter that gradually diminishes rearwardly;

the water let propeller for propelling the hull by expelling a water jet from a rear-end portion of the nozzle by rotating the impeller;

wherein the impeller is rotatably mounted to the stator, being disposed inside the impeller housing;

wherein the impeller housing, the stator. and the nozzle are connected integrally with each other using a first bolt;

wherein the impeller housing and the stator are connected integrally with each other using a second bolt;

wherein the stator includes a water take-out path, through which water in the stator is taken out externally, disposed on an outer wall of the stator;

wherein the impeller housing includes a water guide path in communication with the water take-out path, the water guide path being disposed on an outer wall of the impeller housing;

wherein a first protruding tab and a second protruding tab are disposed on a wall portion forming the water take-out path and a wall portion forming the water guide path, respectively, so as to oppose to each other; and wherein the first and the second protruding tabs are connected together using the second bolt.

9. The water jet propeller according to claim 8, wherein the water take-out path is in communication with a space of a water take-out portion, the space being in communication with the stator via small holes.

10. A water jet propeller, comprising:

a cylindrically shaped impeller housing disposed in a rear portion of a hull;

an impeller disposed inside the impeller housing;

a cylindrically shaped stator disposed at a rear-end portion of the impeller housing; and a nozzle disposed at a rear-end portion of the stator, the nozzle having a diameter that gradually diminishes rearwardly;

the water jet propeller for propelling the hull by expelling a water jet from a rear-end portion of the nozzle by rotating the impeller;

wherein the impeller is rotatably mounted to the stator, being disposed inside the impeller housing;

wherein the impeller housing, the stator, and the nozzle are connected integrally with each other using a first bolt;

wherein the impeller housing and the stator are connected integrally with each other using a second bolt, wherein the impeller housing prevents sides of the impeller from being exposed when the stator and nozzle are removed, and wherein an inside diameter of a front-end portion of the impeller housing is made to increase gradually toward a front edge in order to have the inside diameter be identical to an inside diameter of the rear-end portion of a water flow duct.

11. The water jet propeller according to claim 10, wherein a head portion of the first bolt is disposed to face rearwardly of the hull; and wherein a head portion of the second bolt is disposed to face forwardly of the hull.

12. The water jet propeller according to claim 10, wherein the stator includes a water take-out path, through which water in the stator is taken out externally, disposed on an outer wall of the stator;

wherein the impeller housing includes a water guide path in communication with the water take-out path, the water guide path being disposed on an outer wall of the impeller housing;

wherein a first protruding tab and a second protruding tab are disposed on a wall portion forming the water take-out path and a wall portion forming the water guide path, respectively, so as to oppose to each other; and wherein the first and the second protruding tabs are connected together using the second bolt.

13. The water jet propeller according to claim 12, wherein the water take-out path is in communication with a space of a water take-out portion, the space being in communication with the stator via small holes.

14. The water jet propeller according to claim 10, further comprising a cylindrical liner inserted into an inner periphery of the impeller housing.

15. The water jet propeller according to claim 10, further comprising a stainless steel liner inserted into an inner periphery of the impeller housing, the liner for preventing the inner periphery of the impeller housing from wearing should foreign matter enter between the impeller and the impeller housing 30 during rotation of the impeller.

16. The water jet propeller according to claim 10, wherein the first bolt passes through non-threaded holes in the stator and engages with threaded holes in the impeller housing.

17. The water jet propeller according to claim 10, wherein the impeller housing, the stator, and the nozzle being connecting together, brings a water guide path in the impeller housing into communication with a water take-out path in the stator.

18. The water jet propeller according to claim 10, further comprising a positioning pin between a rear-end portion of the impeller housing and the stator, for simplifying assembling the stator to the impeller housing.

* * * * *